US007419398B2

(12) United States Patent
Goodman

(10) Patent No.: US 7,419,398 B2
(45) Date of Patent: Sep. 2, 2008

(54) HERMAPHRODITIC SOCKET/ADAPTER

(75) Inventor: Glenn Goodman, Cumberland, RI (US)

(73) Assignee: Advanced Interconnections Corporation, West Warwick, RI (US)

( * ) Notice: Subject to any disclaimer, the term of this patent is extended or adjusted under 35 U.S.C. 154(b) by 0 days.

(21) Appl. No.: 11/780,023

(22) Filed: Jul. 19, 2007

(65) Prior Publication Data

US 2007/0298644 A1 Dec. 27, 2007

Related U.S. Application Data

(63) Continuation of application No. 11/335,433, filed on Jan. 18, 2006, now abandoned.

(51) Int. Cl.
*H01R 13/28* (2006.01)

(52) U.S. Cl. ..... 439/284

(58) Field of Classification Search ..... 439/79, 439/291, 284, 292, 331, 330
See application file for complete search history.

(56) References Cited

U.S. PATENT DOCUMENTS

| | | | | | |
|---|---|---|---|---|---|
| 2,124,207 | A | | 7/1938 | Neesen | |
| 2,376,177 | A | * | 5/1945 | Nichols, Jr. | 75/483 |
| 2,384,267 | A | | 9/1945 | Andersen | |
| 2,437,358 | A | | 3/1948 | Mowery | |
| 2,465,419 | A | | 3/1949 | Barany | |
| 3,432,795 | A | | 3/1969 | Jayne | |
| 3,517,373 | A | * | 6/1970 | Jamon | 439/274 |
| 3,582,867 | A | | 6/1971 | Thompson et al. | |
| 3,840,839 | A | * | 10/1974 | Smaczny et al. | 439/294 |
| 3,901,574 | A | * | 8/1975 | Paullus et al. | 439/315 |
| 4,082,397 | A | * | 4/1978 | Tanaka et al. | 439/291 |
| 4,442,938 | A | | 4/1984 | Murphy | |
| RE32,540 | E | | 11/1987 | Murphy | |
| 5,038,467 | A | | 8/1991 | Murphy | |
| 5,088,930 | A | | 2/1992 | Murphy | |
| 5,125,848 | A | | 6/1992 | Zimmerly | |
| 5,176,528 | A | * | 1/1993 | Fry et al. | 439/181 |
| 5,227,718 | A | | 7/1993 | Stowers et al. | |
| 5,306,171 | A | | 4/1994 | Marshall | |
| 5,356,300 | A | | 10/1994 | Costello et al. | |
| 5,420,519 | A | | 5/1995 | Stowers et al. | |
| 5,545,050 | A | | 8/1996 | Sato et al. | |
| 5,576,631 | A | | 11/1996 | Stowers et al. | |
| 5,877,554 | A | | 3/1999 | Murphy | |
| 6,020,635 | A | | 2/2000 | Murphy | |
| 6,065,992 | A | | 5/2000 | Wu et al. | |
| 6,074,236 | A | | 6/2000 | Wu | |
| 6,213,787 | B1 | | 4/2001 | Murphy | |
| 6,299,492 | B1 | | 10/2001 | Pierini et al. | |
| 6,313,530 | B1 | | 11/2001 | Murphy | |
| 6,352,437 | B1 | | 3/2002 | Tate | |
| 6,471,524 | B1 | | 10/2002 | Nakano | |
| 6,896,523 | B2 | | 5/2005 | Nishizawa et al. | |
| 2006/0051987 | A1 | | 3/2006 | Goodman et al. | |

* cited by examiner

*Primary Examiner*—Phuong K Dinh
(74) *Attorney, Agent, or Firm*—Occhiuti Rohlicek & Tsao LLP

(57) ABSTRACT

A hermaphroditic terminal assembly for connecting electrical devices includes an insulating support member for supporting female sockets and male pins, a number of female sockets, and a number of male pins. An intercoupling component for connecting electrical devices includes two hermaphroditic terminal assemblies configured such that the first hermaphroditic terminal assembly can be mated with the second hermaphroditic terminal assembly.

21 Claims, 6 Drawing Sheets

HERMAPHRODITIC SOCKET/ADAPTER

CROSS-REFERENCE TO RELATED APPLICATIONS

The present application claims benefit of U.S. Non-Provisional Application No. 11/335,433, filed on Jan. 18, 2006 now abandoned. The disclosure of said non-provisional application, including the specification, claims and figures, is incorporated herein by reference.

TECHNICAL FIELD

This invention relates to making electrical connections between electrical devices.

BACKGROUND

Electrical connection pins are a popular means for connecting two electrical devices. For example, integrated circuit (IC) packages typically possess a number of male electrical connection pins for mounting the IC package an electrical socket on a printed circuit board (PCB). Each of the male electrical connection pins of the IC package is inserted into corresponding female sockets in the electrical socket on the PCB.

As technology continues to advance, the size of electrical devices continues to decrease while the number of connections required between electrical devices continues to increase. Consequently, increasing the density of electrical connection terminals for electrically connecting two electrical devices is necessary.

SUMMARY

The invention relates to a terminal assembly for electrically connecting two electrical devices as described in U.S. patent application Ser. No. 10/935,880 which is incorporated herein in its entirety. In one aspect of the invention, the terminal assembly includes an insulating support member for supporting female sockets and male pins; a number of female sockets received within a first array of apertures in the insulating support member, each aperture extending from the upper surface of the insulating support member to the bottom surface of the insulating support member; and a number of male pins received within a second array of apertures in the insulating support member, each aperture extending from the upper surface of the insulating support member to the bottom surface of the insulating support member.

Preferred embodiments of this aspect of the invention may include one or more of the following features. The female sockets and male pins are arranged in a pattern such that each interstitial space between the sockets is occupied by a pin and each interstitial space between the pins is occupied by a socket. The terminal assembly is used to electrically connect a first circuit board to a second circuit board. The terminal assembly is used to electrically connect an IC package to a circuit board. The height of at least one of the male pins is different than the height of every other pin. The terminal assembly includes at least one alignment element to align the female sockets and male pins with corresponding male pins and female sockets on a second terminal assembly. For example, the terminal assembly includes at least one alignment guide post or at least one alignment guide hole. The alignment guide post is capable of serving as an electric power, voltage, or ground connection. In these embodiments, the alignment guide posts are advantageously dual-purposed:

serving to both align electrical connections between electrical devices as well as to provide an electrical path themselves. The terminal assembly further includes a member that applies a downward force on the terminal assembly and to each pin and socket.

In another aspect of this invention, an intercoupling component for electrically connecting two electrical devices includes two terminal assemblies of the type described above. The two terminal assemblies are used to electrically connect two electrical devices by inserting the male pins of the first terminal assembly into the female sockets of the second terminal assembly and by inserting the male pins of the second terminal assembly into the female sockets of the first terminal assembly.

Among other advantages, intercoupling components having the structure discussed above provides all of the advantages associated with traditional socket/adapter technology (e.g., non-permanent connections) while providing a substantial increase in the density of electrical connections between electrical devices or substrates (e.g., printed circuit boards) having electrical connections.

In another aspect of this invention, a terminal assembly of the type used to electrically connect electrical devices includes a first insulating support member having a peripheral wall defining an interior recess; a first array of apertures, each aperture extending from an upper surface of the first insulating support member to an opposite lower surface of the first insulating support member contiguous with the recess, each aperture configured to receive a socket, and a second array of apertures, each aperture extending from an upper surface of the first insulating support member to an opposite lower surface of the first insulating support member contiguous with the recess, configured to receive a pin; as well as a plurality of sockets for providing electrical connections arranged in a configuration corresponding with the first array of apertures, each socket received within a corresponding aperture of the first array of apertures of the first insulating support member and having an end with an opening configured to receive a pin of a corresponding terminal assembly and an opposite end configured to contact a corresponding electrical contact; and a plurality of pins for providing electrical connections arranged in a configuration corresponding with the second array of apertures, each pin received within an opening of a corresponding aperture of the second array of apertures of the first insulating support member and having an end configured to be received within a socket of a corresponding terminal assembly and an opposite end configured to contact a corresponding electrical contact.

In another aspect of the invention, an intercoupling component has two such terminal assemblies.

Embodiments of the invention may include one or more of the following features. The female sockets and male pins of the first terminal assembly are arranged in a pattern such that each interstitial space between the sockets is occupied by a pin and each interstitial space between the pins is occupied by a socket. The female sockets and male pins of the second terminal assembly are arranged in a pattern corresponding to the pattern of the female sockets and male pins of the first terminal assembly such that each interstitial space between the sockets is occupied by a pin and each interstitial space between the pins is occupied by a socket. The intercoupling component is used to electrically connect a first circuit board to a second circuit board. The intercoupling component is used to electrically connect an IC package to a circuit board.

In certain embodiments, the first terminal assembly is identical to the second terminal assembly. The height of at least one of the male pins of the first terminal assembly is different than the height of every other pin of the first terminal assembly. The height of at least one of the male pins of the second terminal assembly is different than the height of every other pin of the second terminal assembly. Both the first terminal assembly and the second terminal assembly include at least one alignment element each to align the female sockets and male pins of the first terminal assembly with corresponding male pins and female sockets of the second terminal assembly. For example, the first terminal assembly includes at least one alignment guide post that is inserted into at least one alignment guide hole in the second terminal assembly. The alignment guide post is capable of serving as an electric power, voltage, or ground connection. The intercoupling component further includes a member that applies a downward force on the intercoupling component.

In certain embodiments, the terminal assembly also includes a second insulating support member, the second insulating support member including a third array of apertures corresponding to first array of apertures, each aperture extending from an upper surface of the second insulating support member to an opposite lower surface of the second insulating support member, each aperture configured to receive a socket, and a fourth array of apertures corresponding to the second array of apertures, each aperture extending from an upper surface of the second insulating support member to an opposite lower surface of the second insulating support member, configured to receive a pin. In some instances, the first and second insulating members are attached to each other with the first array of apertures substantially aligned with the third array of apertures and the second array of apertures substantially aligned with the fourth array of apertures.

In certain embodiments, the first array of apertures and the second array of apertures are arranged in a pattern comprising a plurality of columns, each column having an axis, the columns located such that the distance between the axes of adjacent columns is less than a standard diameter of apertures of the first array of apertures. In some instances, each column is arranged in an alternating sequence of sockets and pins.

In another aspect of the invention, a method of manufacturing a terminal assembly of the type used to electrically connect electrical devices includes: providing a first insulating support member including a peripheral wall defining an interior recess; a first array of apertures, each aperture extending from an upper surface of the first insulating support member to an opposite lower surface of the first insulating support member contiguous with the recess, each aperture configured to receive a socket, and a second array of apertures, each aperture extending from an upper surface of the first insulating support member to an opposite lower surface of the first insulating support member contiguous with the recess, configured to receive a pin; providing a plurality of sockets for providing electrical connections, each socket having an end with an opening configured to receive a pin of a corresponding terminal assembly and an opposite end configured to contact a corresponding electrical contact, arranged in a configuration corresponding with the first array of apertures such that each socket is received within a corresponding aperture of the first array of apertures of the insulating support member; and providing a plurality of pins for providing electrical connections, each pin having an end configured to be received within a socket of a corresponding terminal assembly and an opposite end configured to contact a corresponding electrical contact, arranged in a configuration corresponding with the second array of apertures such that each pin is received within an opening of a corresponding aperture of the second array of apertures of the insulating support member.

In some embodiments, the method includes providing the first insulating support member by machining the first and second arrays of apertures in the first support member, each aperture extending from a first surface of the first support member and terminating before reaching an opposite second surface of the first support member; and forming a recess in the opposite second surface of the first support member such that each aperture extends from the first surface of the first support member to a base surface of the recess. In some instances, the method includes attaching a second insulating support member to the first insulating support member, the second insulating support member including a third array of apertures corresponding to first array of apertures, each aperture extending from an upper surface of the second insulating support member to an opposite lower surface of the second insulating support member, each aperture configured to receive a socket, and a fourth array of apertures corresponding to the second array of apertures, each aperture extending from an upper surface of the second insulating support member to an opposite lower surface of the second insulating support member, configured to receive a pin; wherein first and second insulating members are attached to each other with the first array of apertures substantially aligned with the third array of apertures and the second array of apertures substantially aligned with the fourth array of apertures.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
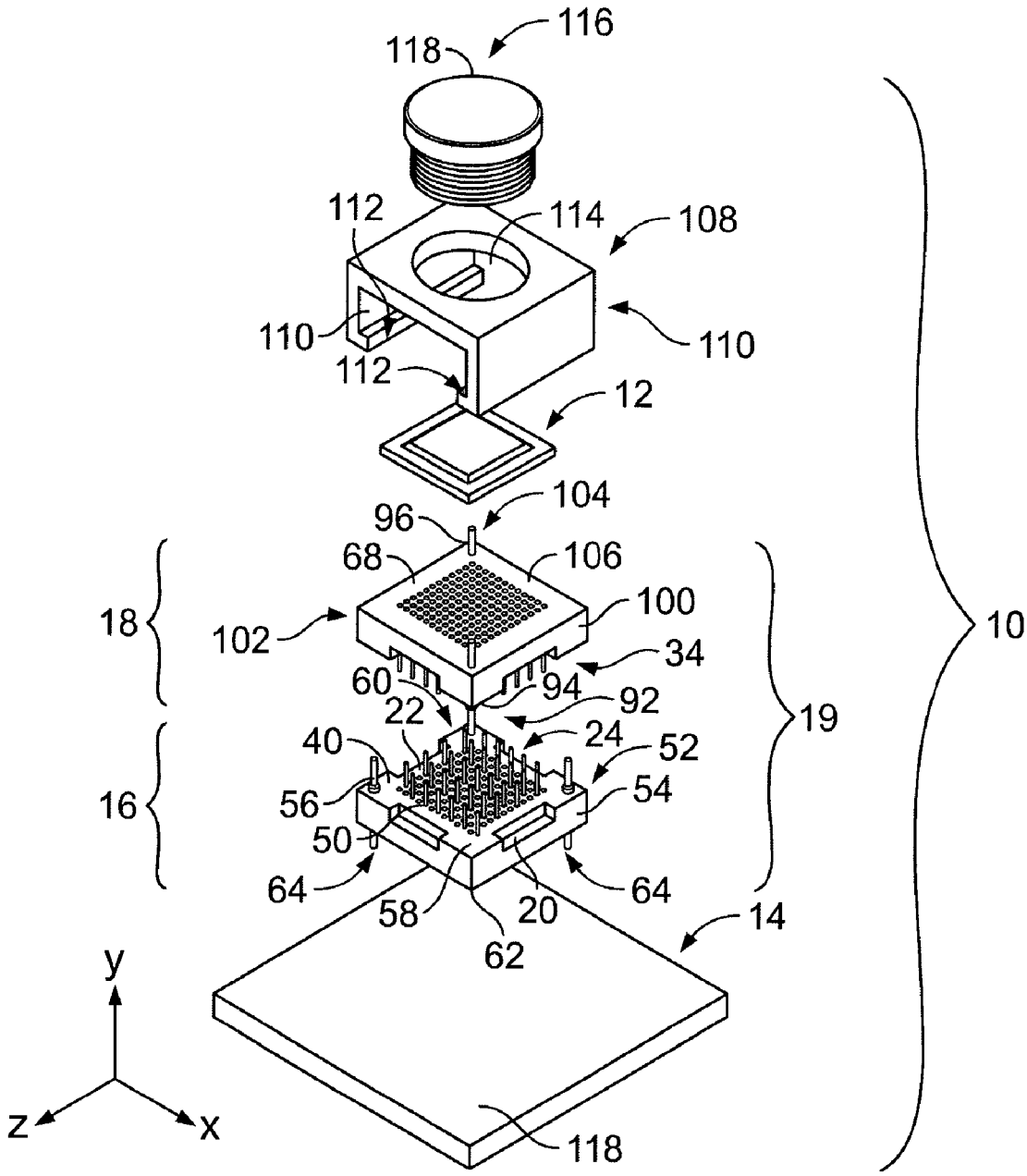
FIG. 1 is an exploded, isometric view of an intercoupling component including two hermaphroditic terminal assemblies, an IC package, and a hold-down assembly positioned over a printed circuit board.
Figure 2A:
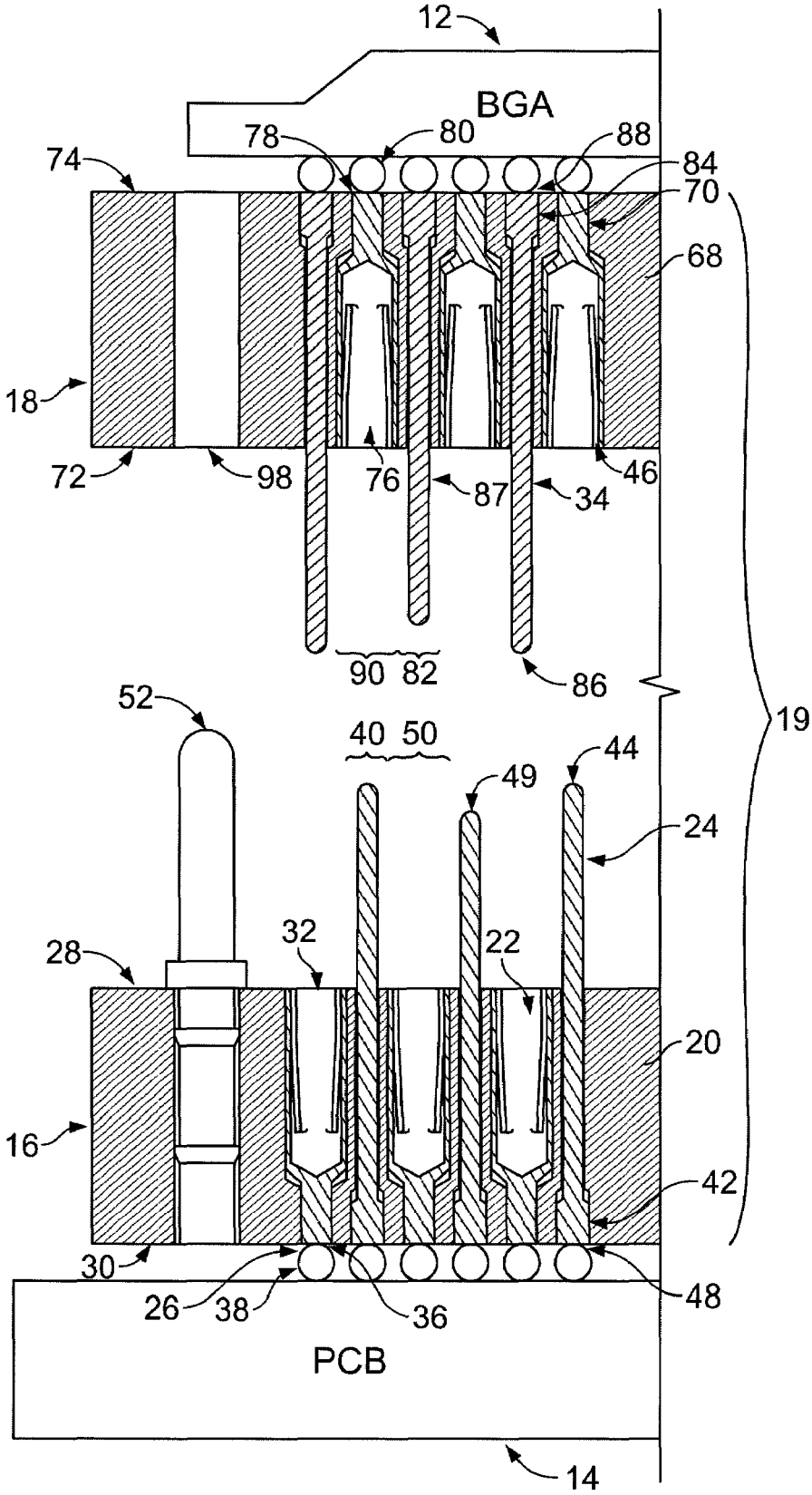
FIGS. 2A-2B are cross-sectional side views of a portion of the intercoupling component of FIG. 1.
Figure 2B:
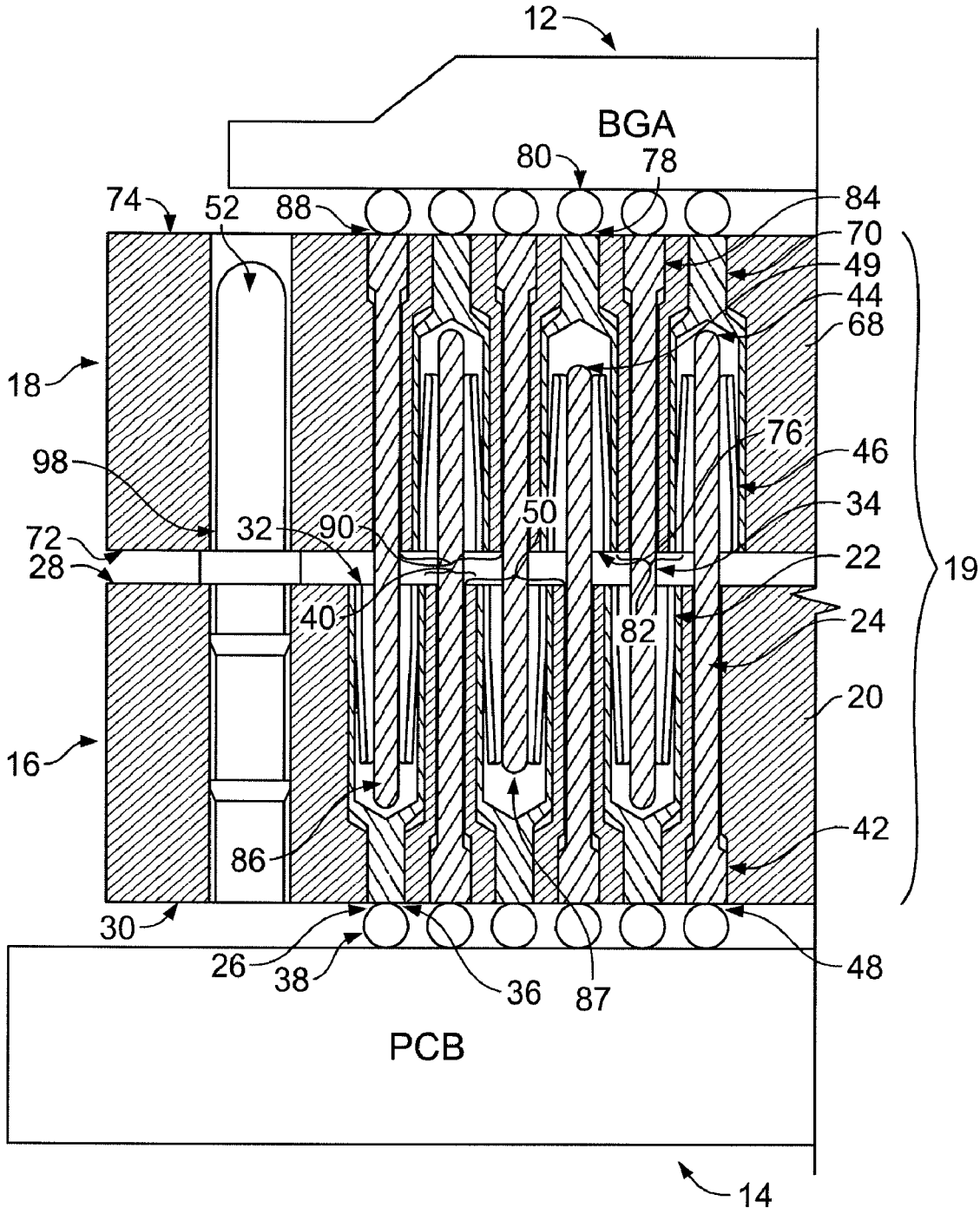

Referring to FIGS. 1, 2A, and 2B, a hermaphroditic socket/adapter assembly 10 for electrically connecting an IC package 12 to a PCB 14 is shown. Hermaphroditic socket/adapter assembly 10, includes a first hermaphroditic terminal assembly 16 and a second hermaphroditic terminal assembly 18 that together comprise an intercoupling component 19.

First hermaphroditic terminal assembly 16 includes an insulating support member 20 for supporting female sockets 22 and male pins 24. Insulating support member 20 includes a first array of apertures 26, extending from the upper surface 28 of insulating support member 20 to the bottom surface 30 of insulating support member 20. Each female socket 22 is received within one aperture 26 of the first array of apertures of the insulating support member 20. Each female socket 22 has a first end 32 configured to receive a corresponding male pin 34 of the second hermaphroditic terminal assembly 18 and a second end 36 attached to a solder ball 38 that establishes an electrical connection with the electrical contact 39 on PCB 14. The female sockets 22 received within the first array of apertures 26 of the insulating support member 20 are arranged such that interstitial spaces 40 exist between the female sockets 22.

Insulating support member 20 also includes a second array of apertures 42, extending from the upper surface 28 of insulating support member 20 to the bottom surface 30 of insulating support member 20. Each male pin 24 is received within one aperture 42 of the second array of apertures of the insulating support member 20. Each male pin has a first end 44 configured to be received within a corresponding female socket 46 of the second hermaphroditic terminal assembly 18 and a second end 48 attached to a solder ball 38 that establishes an electrical connection with electrical contact 39 on PCB 14. In some applications, it may be desirable for at least one male pin 49 to be of a different height than every other male pin 24 where the height of a pin is defined as the length from the first end of the pin 44 to the second end of the pin 48. Varying the height of the pins serves to decrease the force required to insert the first hermaphroditic terminal assembly 16 into a corresponding hermaphroditic terminal assembly. Varying the height of the pins also serves to decrease the force required to extract the first hermaphroditic terminal assembly 16 from a corresponding hermaphroditic terminal assembly into which it has been inserted. The male pins 24 received within the second array of apertures 42 of the insulating support member 20 are arranged such that interstitial spaces 50 exist between the male pins 24. Collectively, the female sockets 22 and the male pins 24 are arranged in a pattern such that the interstitial spaces 40 between the female sockets 22 are occupied by male pins 24, and the interstitial spaces 50 between the male pins 24 are occupied by female sockets 22. It is appreciated that the female sockets 22 and the male pins 24 could be arranged in different patterns.

First hermaphroditic terminal assembly 16 also includes two alignment guide posts 52 located in opposite corners 54, 56 of first hermaphroditic terminal assembly 16 and disposed through the upper surface 28 of the insulating support member 20 and two alignment guide holes 58 located in opposite corners 60, 62 of the upper surface 28 of the insulating support member 20. In addition, first hermaphroditic terminal assembly 16 includes two alignment guide posts 64 located in opposite corners 54, 56 of first hermaphroditic terminal assembly 16 and disposed through the lower surface 30 of the insulating support member 20 and two alignment guide holes (not shown) located in opposite corners 60, 62 of the lower surface 30 of the insulating support member 20.

Second hermaphroditic terminal assembly 18 includes an insulating support member 68 for supporting female sockets 46 and male pins 34. Insulating support member 68 includes a first array of apertures 70, extending from the upper surface 72 of insulating support member 68 to the bottom surface 74 of insulating support member 68. Each female socket 46 is received within one aperture 70 of the first array of apertures of the insulating support member 68. Each female socket 46 has a first end 76 configured to receive a corresponding male pin 24 of the first hermaphroditic terminal assembly 16 and a second end 78 configured to contact a solder ball 80 on IC package 12. The female sockets 46 received within the first array of apertures 70 of the insulating support member 68 are arranged such that interstitial spaces 82 exist between the female sockets 46.

Insulating support member 68 also includes a second array of apertures 84, extending from the upper surface 72 of insulating support member 68 to the bottom surface 74 of insulating support member 68. Each male pin 34 is received within one aperture 84 of the second array of apertures of the insulating support member 68. Each male pin has a first end 86 configured to be received within a corresponding female socket 22 of the first hermaphroditic terminal assembly 16 and a second end 88 configured to contact a corresponding solder ball 80 on IC package 12. In some applications, it may be desirable for at least one male pin 87 to be of a different height than every other male pin 34, where the height of a pin is defined as the length from the first end of the pin 86 to the second end of the pin 88. Varying the height of the pins serves to decrease the force required to insert the second hermaphroditic terminal assembly 18 into a corresponding hermaphroditic terminal assembly. Varying the height of the pins also serves to decrease the force required to extract the second hermaphroditic terminal assembly 18 from a corresponding hermaphroditic terminal assembly into which it has been inserted. The male pins 34 received within the second array of apertures 84 of the insulating support member 68 are arranged such that interstitial spaces 90 exist between the male pins 34. Collectively, the female sockets 46 and the male pins 34 are arranged in a pattern such that the interstitial spaces 82 between the female sockets 46 are occupied by male pins 34, and the interstitial spaces 90 between the male pins 34 are occupied by female sockets 46. It is appreciated that the female sockets 46 and the male pins 34 could be arranged in different patterns.

Second hermaphroditic terminal assembly 18 also includes two alignment guide posts 92 located in opposite corners 94, 96 of second hermaphroditic terminal assembly 18 and disposed through the upper surface 72 of the insulating support member 68 and two alignment guide holes 98 located in opposite corners 100, 102 of the upper surface 72 of the insulating support member 68. In addition, second hermaphroditic terminal assembly 18 includes two alignment guide posts 104 located in opposite corners 94, 96 of second hermaphroditic terminal assembly 18 and disposed through the lower surface 74 of the insulating support member 68 and two alignment guide holes 98 located in opposite corners 100, 102 of the lower surface 74 of the insulating support member 68.

The intercoupling component 19 is used to electrically connect IC package 12 to PCB 14. IC package 12 is secured to the lower surface 74 of insulating support member 68 of the second hermaphroditic terminal assembly 18 such that the solder balls 80 on IC package 12 are brought into contact with the second ends 78 of the female sockets 46 of the second hermaphroditic terminal assembly 18 and the second ends 88 of the male pins 34 of the second hermaphroditic terminal assembly 18. The alignment guide posts 104 disposed through the lower surface 74 the insulating support member 68 of the second terminal assembly can be used to properly align the solder balls 80 on IC package 12 with the second ends 78 of the female sockets 46 of the second hermaphroditic terminal assembly 18 and the second ends 88 of the male pins 34 of the second hermaphroditic terminal assembly 18. It is appreciated that other alignment elements could be used to facilitate proper alignment of the solder balls 80 on IC package 12 with the second ends 78 of the female sockets 46 of the second hermaphroditic terminal assembly 18 and the second ends of the male pins 34 of the second hermaphroditic terminal assembly 18. It is also appreciated that alignment elements are not required to properly align the electrical contacts 80 on IC package 12 with the second ends 78 of the female sockets 46 of the second hermaphroditic terminal assembly 18 and the second ends of the male pins 34 of the second hermaphroditic terminal assembly 18.

Hermaphroditic socket/adapter assembly 10 includes a hold-down cover 108 for securing the IC package 12 to the intercoupling component 19. Hold-down cover 108 includes a pair of opposite walls 110 having tab members 112 that engage the intercoupling component 19. Hold-down cover 108 includes a threaded thru-hole 114 that threadingly receives a heat sink 116 to provide a thermal path for dissipating heat from the IC package 12. Heat sink 116 is inserted through threaded thru-hole 114 and a slot 118 formed in the heat sink 116 facilitates threading the heat sink 116 within the cover, for example, with a screwdriver or coin. It is appreciated that other mechanisms may also be used to secure the IC package 12 to the intercoupling component 19. It is also appreciated that other heat sink arrangements may be substituted for the version shown in FIG. 1. In some applications, a heat sink may not be required. Therefore, it is appreciated that the hold-down cover 108 may be used to secure the IC package 12 to the intercoupling component 19 without a heat sink. It is also appreciated that the hold-down cover itself may not be necessary to secure the IC package 12 to the intercoupling component 19. In some applications, the IC package 12 may be soldered directly to the intercoupling component 19.

The second hermaphroditic terminal assembly 18 is coupled to the first hermaphroditic terminal assembly 16 by inserting each male pin 34 of the second terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18. When the second hermaphroditic terminal assembly 18 is coupled to the first hermaphroditic terminal assembly 16, it is said to be mated with the first hermaphroditic terminal assembly 16. The alignment guide posts 92 disposed through the upper surface 72 of the insulating support member 68 of the second hermaphroditic terminal assembly 18 are inserted into alignment guide holes 58 in the upper surface 28 of the insulating support member 20 of the first hermaphroditic terminal assembly 16 and the alignment guide posts 52 disposed through the upper surface 28 of the first hermaphroditic terminal assembly 16 are inserted into alignment guide holes 98 in the upper surface 72 of the insulating support member 68 of the second hermaphroditic terminal assembly 18 to properly align the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. It is appreciated that other alignment elements could be used to facilitate proper alignment of the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. It is also appreciated that alignment elements are not required to properly align the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. In some applications, it may be advantageous for the alignment guide posts 92 disposed through the upper surface 72 of insulating support member 68 of the second hermaphroditic terminal assembly 18 and the alignment guide posts 52 disposed through the upper surface 28 of the first hermaphroditic terminal assembly 16 to serve as power, voltage, or ground connections.

Referring to FIG. 1, first hermaphroditic terminal assembly 16 is identical to second hermaphroditic terminal assembly 18. In order to connect first hermaphroditic terminal assembly 16 to second hermaphroditic terminal assembly 18, second hermaphroditic terminal assembly 18 is rotated 90 degrees so that the male pins 34 of the second hermaphroditic terminal assembly 18 are aligned with corresponding female sockets 22 of the first hermaphroditic terminal assembly 16 and the male pins 24 of the first hermaphroditic terminal assembly 16 are aligned with corresponding female sockets 46 of the second hermaphroditic terminal assembly 18. It is appreciated that the first hermaphroditic terminal assembly 16 need not be identical to the second hermaphroditic terminal assembly 18.

First hermaphroditic terminal assembly 16 is secured to PCB 14 such that the solder balls 38 attached to second ends 36 of the female sockets 22 of the first hermaphroditic terminal assembly 16 and the solder balls 38 attached to second ends 48 of the male pins 24 of the first hermaphroditic terminal assembly 16 are in contact with the electrical contacts 39 on PCB 14. The alignment guide posts 64 disposed through the lower surface 30 of the insulating support member 20 of the first hermaphroditic terminal assembly 16 are inserted into alignment guide holes 128 in PCB 14. It is appreciated that other alignment elements could be used to facilitate proper alignment of the solder balls 38 attached to second ends 36 of the female sockets 22 of the first hermaphroditic terminal assembly 16 and the solder balls 38 attached to second ends 48 of the male pins 24 of the first hermaphroditic terminal assembly 16 with the electrical contacts 39 on PCB 14. It is also appreciated that alignment elements are not required.

When IC package 12 is secured to the lower surface 74 of insulating support member 68 of the second hermaphroditic terminal assembly 18 such that the solder balls 80 on IC package 12 are in contact with the second ends 78 of the female sockets 46 of the second hermaphroditic terminal assembly 18 and the second ends 88 of the male pins 34 of the second hermaphroditic terminal assembly 18; second hermaphroditic terminal assembly 18 is coupled to the first hermaphroditic terminal assembly 16 such that each male pin 34 of the second hermaphroditic terminal assembly 18 is received within a corresponding female socket 22 of the first hermaphroditic terminal assembly 16 and each male pin 24 of the first hermaphroditic terminal assembly 16 is received within a corresponding female socket 46 of the second hermaphroditic terminal assembly 18; and first hermaphroditic terminal assembly 16 is secured to PCB 14 such that that the solder balls 38 attached to second ends 36 of the female sockets 22 of the first hermaphroditic terminal assembly 16 and the solder balls 38 attached to second ends 48 of the male pins 24 of the first terminal assembly 16 are in contact with the electrical contacts 39 on PCB 14, the IC package 12 being electrically connected to PCB 14.

FIGS. 2A and 2B illustrate the operation of intercoupling component 19. The solder balls 38 attached to second ends 36 of the female sockets 22 of the first hermaphroditic terminal assembly 16 and the solder balls 38 attached to second ends 48 of the male pins 24 of the first hermaphroditic terminal assembly 16 are in contact with the electrical contacts 39 on PCB 14. Similarly, the second ends 78 of the female sockets 46 of the second hermaphroditic terminal assembly 18 and the second ends 88 of the male pins 34 of the second hermaphroditic terminal assembly 18 are in contact with the solder balls 80 on IC package 12. Referring to FIG. 2A, IC package 12 and PCB 14 are not electrically connected. Referring to FIG. 2B, intercoupling component 19 is used to electrically connect IC package 12 and PCB 14. The electrical connection between IC package 12 and PCB 14 is formed by inserting each male pin 34 of the second hermaphroditic terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18.

Figure 4:
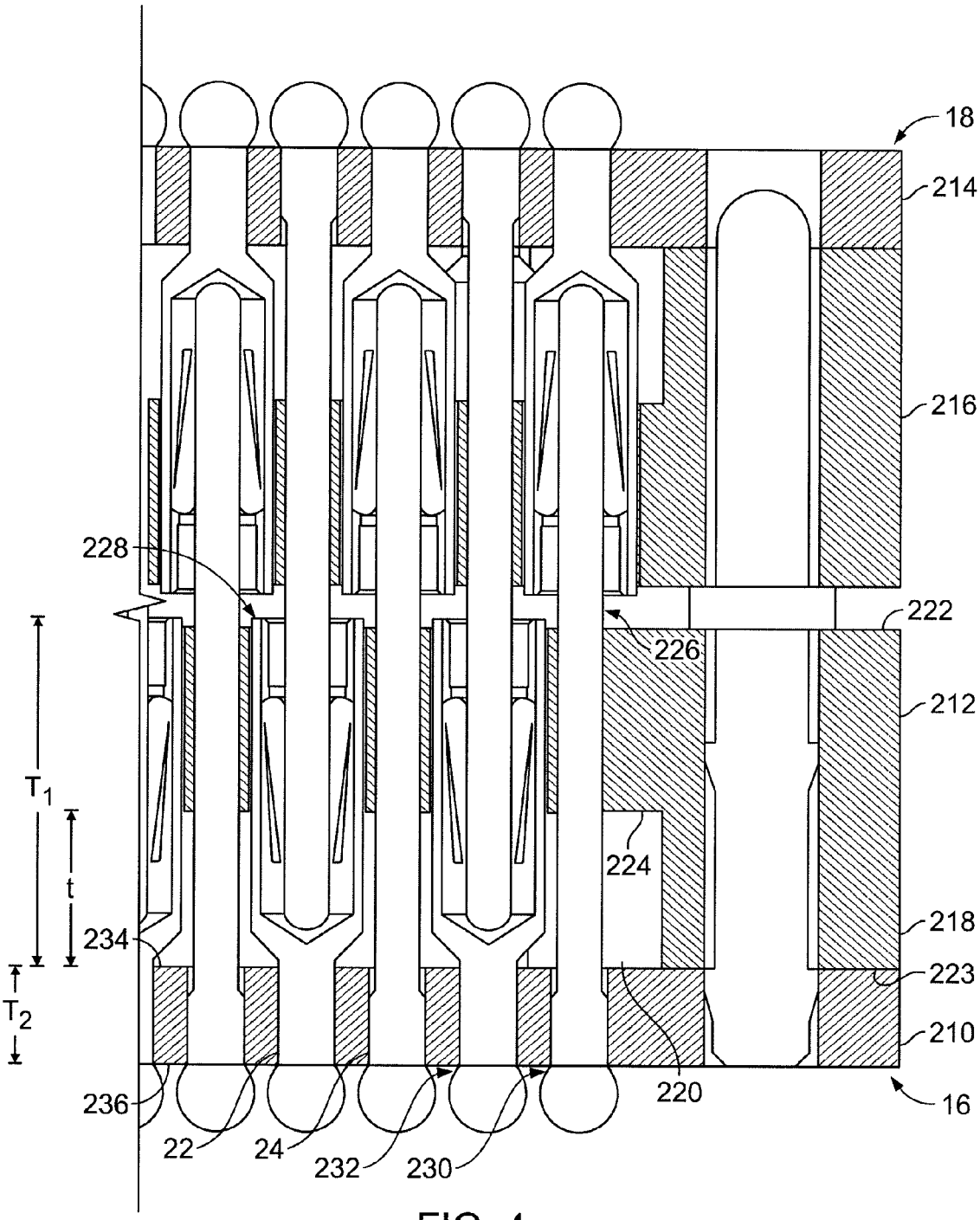
FIG. 4 is a cross-sectional side view of an alternate intercoupling component.
Figure 5:
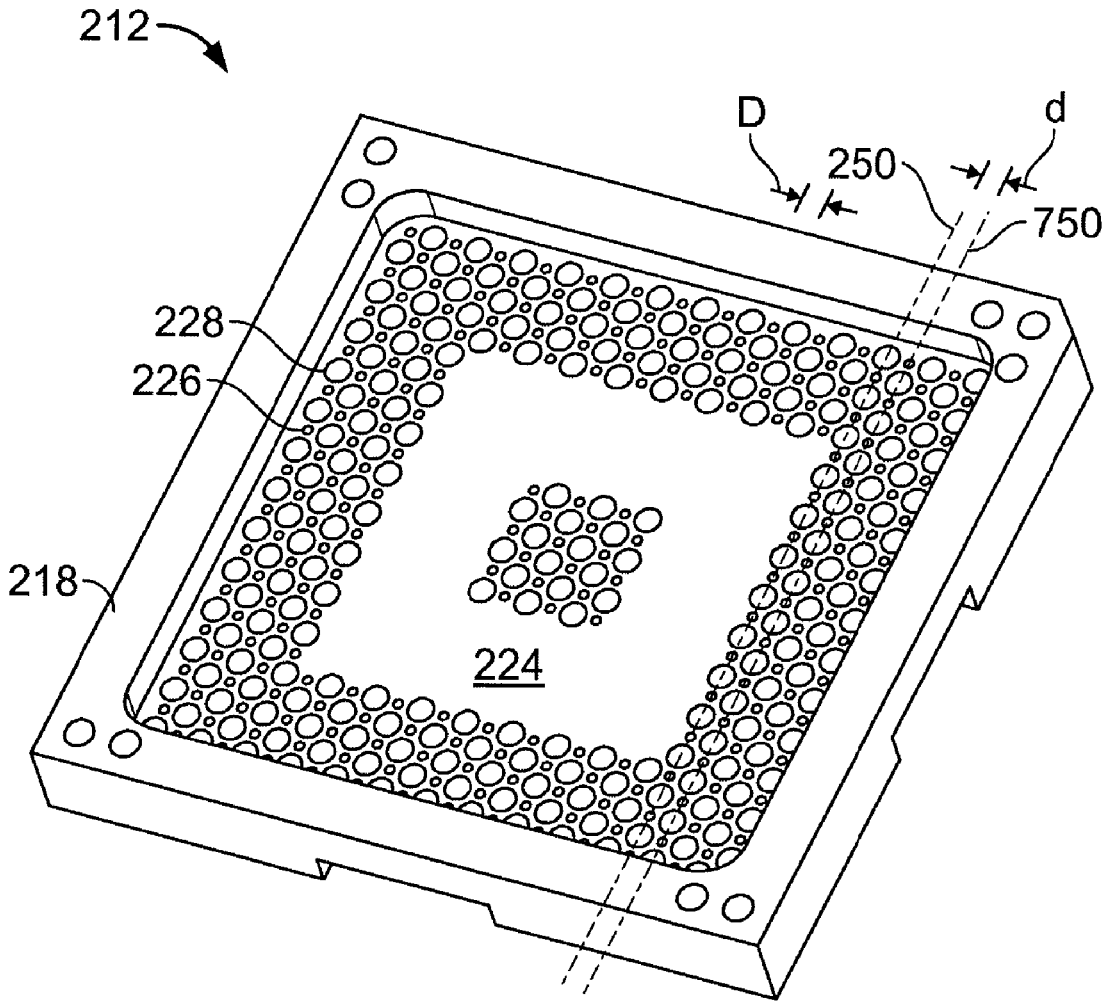
FIG. 5 is a perspective view of an insulating support member of the intercoupling component of FIG. 4.

Other embodiments of a hermaphroditic socket adapter assembly may be configured in a manner that provides improved electrical characteristics (e.g., improved capacitance, impedance, and electromagnetic coupling characteristics). For example, referring to FIGS. 4 and 5, terminal assemblies 16, 18 have a first insulating support member 212, 216 that include a peripheral wall 218 that defines an interior recess 220. First insulating support member 212 also includes a first array of apertures 228, each aperture extending from an upper surface 222 of the first insulating support member to an opposite lower surface 224 of the first insulating support member contiguous with recess 220, each aperture 228 configured to receive socket 22. First insulating support member 212 also includes a second array of apertures 226, each aperture extending from upper surface 222 of the first insulating support member to opposite lower surface 224 of the first insulating support member contiguous with recess 220, each aperture 226 configured to receive pin 24. Sockets 22 and pins 24 as described above can be used. In some instances, first insulating support member 212 can have a thickness $T_1$ between about 0.020 and 1.0 inch (e.g., between about 0.050 and 0.100 inch; or between about 0.070 and 0.080 inch) and recess 220 can have a depth t between about 0.010 and 0.980 inch (e.g., between about 0.025 and 0.050 inch; or between about 0.030 and 0.040 inch).

Terminal assemblies 16, 18 also include a second insulating support member 210, 214. Second insulating support members 210, 214 include a third array of apertures 232 corresponding to first array of apertures 228, each aperture extending from an upper surface 234 of the second insulating support member to an opposite lower surface 236 of the second insulating support member, each aperture configured to receive a socket 22. Second insulating support members 210, 214 also include a fourth array of apertures 230 corresponding to the second array of apertures 226, each aperture extending from upper surface 234 of the second insulating support member to opposite lower surface 236 of the second insulating support member, each aperture 230 configured to receive a pin 24. Second insulating support member 210 can have a thickness $T_2$ between about 0.001 and 0.050 inch (e.g., between about 0.015 and 0.025 inch).

The fact that only air separates adjacent sockets 22 and pins 24 in recess 220 can provide the designer of such terminal assemblies with the ability to adjust the electrical characteristics relative to terminal assemblies without such recesses 20. For example, the dimensions of recess 220 can optimized or otherwise adjusted to produced terminal assemblies with specific desired electrical characteristics (e.g., capacitance, impedance, and electromagnetic coupling characteristics).

In some instances, first insulating support member 212 can be produced by machining the first and second arrays of apertures 226, 228 in a first support member with each aperture extending from a first surface 222 of the first support member and terminating before reaching an opposite second surface 223 of the first support member.

A recess 220 can then be formed by, for example, machining or counter-boring in opposite second surface 223 of the first support member such that each aperture 226, 228 extends from first surface 222 of the first support member to a base surface 224 of the recess. A second insulating support member 210 can then be attached to first insulating support member 212 with apertures 230, 232 corresponding to and aligned with apertures 226, 228. Sockets 22 and pins 24 can be press fit within the apertures. In some instances, machining apertures 226, 228 only partway through first insulating support member 212 provides increased ease of machining and improved true positioning of the apertures relative to methods of manufacturing in which apertures 226, 228 are machined through the full thickness of an insulating support member. The advantage of this approach increases with the increasing thickness of the insulating support member to which it is applied.

Referring to FIGS. 1-5, arrays of socket-receiving apertures 26, 70, 228, 232 and arrays of pin receiving apertures 42, 84, 226, 230 can be arranged in a pattern comprising a plurality of columns with each column having an axis 250. The columns located such that the distance d between the axes of adjacent columns is less than a standard diameter D of socket-receiving apertures 26, 70, 228, 232. This arrangement can provide for reduced spacing between adjacent pin/socket pairs.

Figure 3:
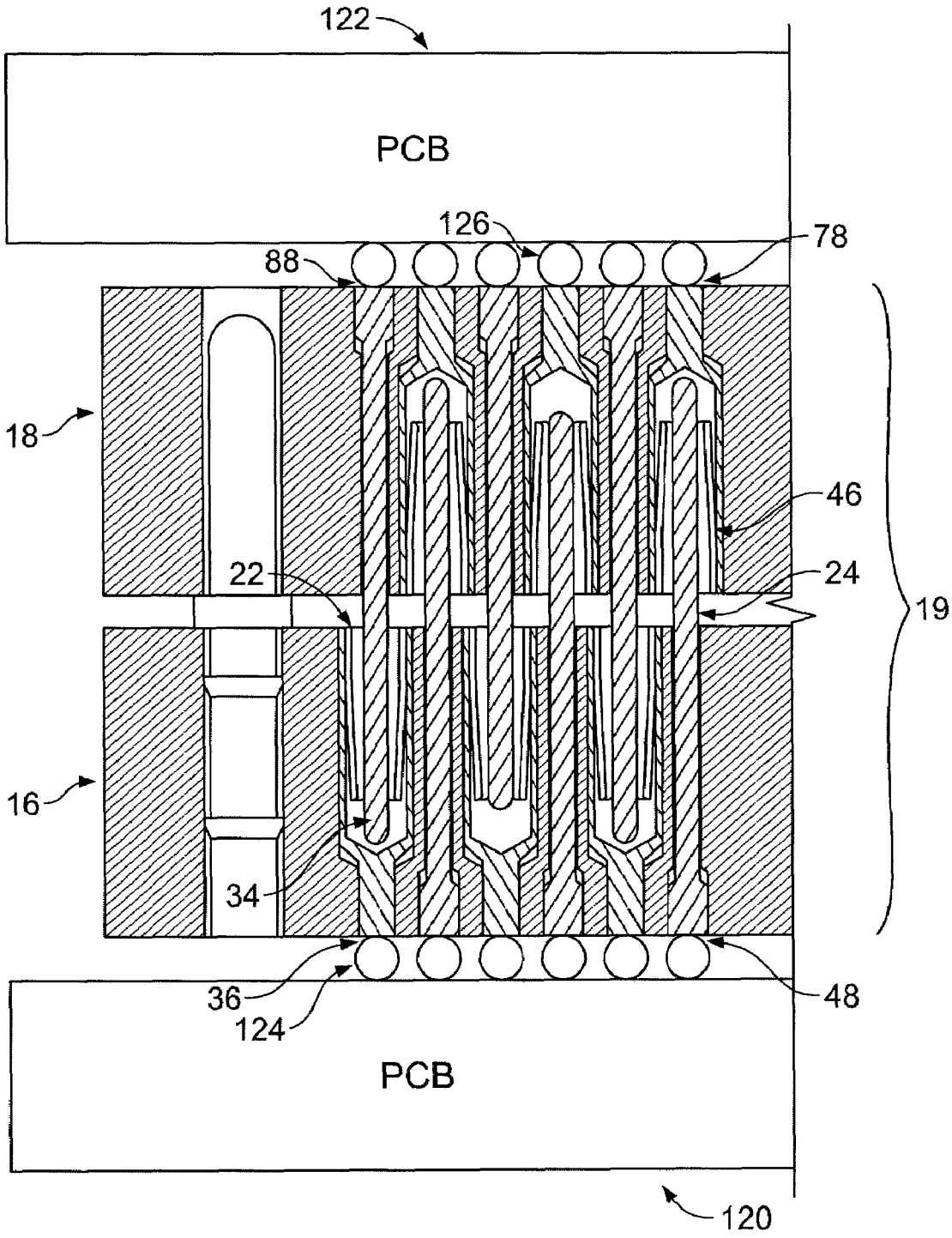
FIG. 3 is a cross-sectional side view of a portion of an alternative embodiment of an intercoupling component.

A number of embodiments of the invention have been described. Nevertheless, it will be understood that various modifications may be made without departing from the spirit and scope of the invention. For example, hermaphroditic terminal assemblies can be used to electrically connect many different types of electrical devices. Referring to FIG. 3, intercoupling component 19, including first hermaphroditic terminal assembly 16 and second hermaphroditic terminal assembly 18, are used to electrically connect a first PCB 120 to a second PCB 122. The second ends 36 of the female sockets 22 of the first hermaphroditic terminal assembly 16 and the second ends 48 of the male pins 24 of the first hermaphroditic terminal assembly 16 are connected to solder balls 124 and form an electrical connection with the electrical contacts 125 on first PCB 120. Similarly, the second ends 78 of the female sockets 46 of the second hermaphroditic terminal assembly 18 and the second ends 88 of the male pins 34 of the second hermaphroditic terminal assembly 18 are connected to solder balls 126 and form an electrical connection with the electrical contacts 127 on second PCB 122. The electrical connection between first PCB 120 and second PCB 122 is formed by inserting each male pin 34 of the second hermaphroditic terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18. Accordingly, other embodiments are within the scope of the following claims.

What is claimed is:

1. A terminal assembly of the type used to provide an electrical connection between electrical devices, the terminal assembly comprising:

a first insulating support member including a peripheral wall defining an interior recess having dimensions configured to provide a predetermined electrical characteristic associated with the electrical connection between electrical devices;

a first array of apertures, each aperture extending from an upper surface of the first insulating support member to an opposite lower surface of the first insulating support member contiguous with the recess, each aperture configured to receive a socket, and a second array of apertures, each aperture extending from an upper surface of the first insulating support member to an opposite lower surface of the first insulating support member contiguous with the recess, configured to receive a pin;

a second insulating support member, the second insulating support member including:

a third array of apertures corresponding to first array of apertures, each aperture extending from an upper surface of the second insulating support member to an opposite lower surface of the second insulating support member, each aperture configured to receive a socket, and a fourth array of apertures corresponding to the second array of apertures, each aperture extending from an upper surface of the second insulating support member to an opposite lower surface of the second insulating support member, configured to receive a pin;

a plurality of sockets for providing electrical connections arranged in a configuration corresponding with the first array of apertures, each socket received within a corresponding aperture of the first array of apertures of the first insulating support member and having an end with an opening configured to receive a pin of a corresponding terminal assembly and an opposite end configured to contact a corresponding electrical contact; and a plurality of pins for providing electrical connections arranged in a configuration corresponding with the second array of apertures, each pin received within an opening of a corresponding aperture of the second array of apertures of the first insulating support member and having an end configured to be received within a socket of a corresponding terminal assembly and an opposite end configured to contact a corresponding electrical contact, wherein first insulating support member and the second insulating support member are attached to each other with the first array of apertures substantially aligned with the third array of apertures and the second array of apertures substantially aligned with the fourth array of apertures, the second insulating support member extending across an open side of the interior recess, wherein the pattern includes a plurality of rows, each row arranged in an alternating sequence of sockets and pins such that each interstitial space between the sockets is occupied by a pin and each interstitial space between the pins is occupied by a socket.

2. The terminal assembly of claim 1 wherein the terminal assembly further comprises a plurality of interstitial spaces between the sockets; and a plurality of interstitial spaces between the pins; and wherein the plurality of sockets and the plurality of pins are arranged in a pattern comprising a plurality of columns, each column arranged in an alternating sequence of sockets and pins such that each interstitial space between the sockets is occupied by a pin and each interstitial space between the pins is occupied by a socket.

3. The terminal assembly of claim 1 wherein the first array of apertures and the second array of apertures are arranged in a pattern comprising a plurality of columns, each column having an axis, the columns located such that the distance between the axes of adjacent columns is less than a standard diameter of apertures of the first array of apertures.

4. The terminal assembly of claim 3 wherein each column is arranged in an alternating sequence of sockets and pins.

5. The terminal assembly of claim 3 wherein the height of at least one pin of the plurality of pins is different than the height of every other pin.

6. The terminal assembly of claim 3 wherein the insulating support member includes at least one alignment element to align the plurality of sockets with a corresponding plurality of pins on a corresponding terminal assembly, and to align the plurality of pins with a corresponding plurality of sockets on a corresponding terminal assembly.

7. The terminal assembly of claim 6 wherein the at least one alignment element comprises at least one alignment guide post disposed through the insulating support member to be received by a corresponding alignment hole in a corresponding terminal assembly.

8. The terminal assembly of claim 7 wherein the at least one guide post provides an electrical connection.

9. The terminal assembly of claim 1 wherein the second insulating support member is configured to close the open side of the interior recess.

10. An intercoupling component of the type used to provide an electrical connection between electrical devices, the intercoupling component comprising:

a first terminal assembly including:

a first insulating support member including a peripheral wall defining an interior recess, the interior recess having dimensions configured to provide a predetermined electrical characteristic associated with the electrical connection between electrical devices;

a first array of apertures, each aperture extending from an upper surface of the first insulating support member to an opposite lower surface of the first insulating support member contiguous with the recess, each aperture configured to receive a socket, and a second array of apertures, each aperture extending from an upper surface of the first insulating support member to an opposite lower surface of the first insulating support member contiguous with the recess, configured to receive a pin;

a third insulating support member, the third insulating support member including a fifth array of apertures corresponding to first array of apertures, each aperture extending from an upper surface of the third insulating support member to an opposite lower surface of the third insulating support member, each aperture configured to receive a socket, and a sixth array of apertures corresponding to the second array of apertures, each aperture extending from an upper surface of the third insulating support member to an opposite lower surface of the third insulating support member, configured to receive a pin, wherein the first and third insulating support members are attached to each other with the first array of apertures substantially aligned with the fifth array of apertures and the second array of apertures substantially aligned with the sixth array of apertures, the third insulating support member extending across an open side of the interior recess;

a first plurality of sockets for providing electrical connections arranged in a configuration corresponding with the first array of apertures, each socket received within a corresponding aperture of the first array of apertures of the first insulating support member and having an end with an opening configured to receive a pin of a corresponding terminal assembly and an opposite end configured to contact a corresponding electrical contact; and a first plurality of pins for providing electrical connections arranged in a configuration corresponding with the second array of apertures, each pin received within an opening of a corresponding aperture of the second array of apertures of the first insulating support member and having an end configured to be received within a socket of a corresponding terminal assembly and an opposite end configured to contact a corresponding electrical contact; and a second terminal assembly including:

a second insulating support member including a second peripheral wall defining a second interior recess, the second interior recess having dimensions configured to provide a predetermined electrical characteristic associated with the electrical connection between electrical devices;

a third array of apertures, each aperture extending from an upper surface of the second insulating support member to an opposite lower surface of the second insulating support member contiguous with the second recess, each aperture configured to receive a socket, and a fourth array of apertures, each aperture extending from an upper surface of the second insulating support member to an opposite lower surface of the second insulating support member contiguous with the second recess, configured to receive a pin;

a second plurality of sockets for providing electrical connections arranged in a configuration corresponding with the third array of apertures, each socket received within a corresponding aperture of the third array of apertures of the second insulating support member and having an end with an opening configured to receive a corresponding pin of the first terminal assembly and an opposite end configured to contact a corresponding electrical contact;

a second plurality of pins for providing electrical connections arranged in a configuration corresponding with the fourth array of apertures, each pin received within an opening of a corresponding aperture of the fourth array of apertures of the second insulating support member and having an end configured to be received within a corresponding socket of the first terminal assembly and an opposite end configured to contact a corresponding electrical contact, wherein the first terminal assembly further comprises a plurality of interstitial spaces between the first plurality of sockets, and a plurality of interstitial spaces between the first plurality of pins; and wherein the first plurality of sockets and the first plurality of pins of the first terminal assembly are arranged in a pattern comprising: a plurality of columns, each column arranged in an alternating sequence of sockets and pins such that each interstitial space between the sockets is occupied by a pin and each interstitial space between the pins is occupied by a socket; and a plurality of rows, each row arranged in an alternating sequence of sockets and pins such that each interstitial space between the sockets is occupied by a pin and each interstitial space between the pins is occupied by a socket.

11. The intercoupling component of claim 10 wherein the first array of apertures and the second array of apertures are arranged in a pattern comprising a plurality of columns, each column having an axis, the columns located such that the distance between adjacent columns is less than a standard diameter of apertures of the first array of apertures.

12. The intercoupling component of claim 10 wherein the third insulating support member is configured to close the open side of the interior recess of the first insulating support member.

13. A method of manufacturing a terminal assembly of the type used to provide an electrical connection between electrical devices, the method comprising:

providing a first insulating support member including a peripheral wall defining an interior recess;

a first array of apertures, each aperture extending from an upper surface of the first insulating support member to an opposite lower surface of the first insulating support member contiguous with the recess, each aperture configured to receive a socket, and a second array of apertures, each aperture extending from an upper surface of the first insulating support member to an opposite lower surface of the first insulating support member contiguous with the recess, configured to receive a pin;

providing a second insulating support member, the second insulating support member including a third array of apertures corresponding to first array of apertures, each aperture extending from an upper surface of the second insulating support member to an opposite lower surface of the second insulating support member, each aperture configured to receive a socket, and a fourth array of apertures corresponding to the second array of apertures, each aperture extending from an upper surface of the second insulating support member to an opposite lower surface of the second insulating support member, configured to receive a pin;

attaching a second insulating support member to the first insulating support member such that the interior recess becomes a closed space, the interior recess having dimensions configured to provide a predetermined electrical characteristic associated with the electrical connection between electrical devices, and such that the first and second insulating support members are attached to each other with the first array of apertures substantially aligned with the third array of apertures and the second array of apertures substantially aligned with the fourth array of apertures;

providing a plurality of sockets for providing electrical connections, each socket having an end with an opening configured to receive a pin of a corresponding terminal assembly and an opposite end configured to contact a corresponding electrical contact, arranged in a configuration corresponding with the first array of apertures such that each socket is received within corresponding apertures of the first and third arrays of apertures of the insulating support members; and providing a plurality of pins for providing electrical connections, each pin having an end configured to be received within a socket of the corresponding terminal assembly and an opposite end configured to contact a corresponding electrical contact, arranged in a configuration corresponding with the second array of apertures such that each pin is received within openings of a corresponding apertures of the second and fourth arrays of apertures of the insulating support member, wherein the configuration of the plurality of sockets defines a plurality of interstitial spaces between the sockets; the configuration of the plurality of pins defines a plurality of interstitial spaces between the pins; and the plurality of sockets and the plurality of pins are arranged in a pattern comprising a plurality of columns, each column arranged in an alternating sequence of sockets and pins such that each interstitial space between the sockets is occupied by a pin and each interstitial space between the pins is occupied by a socket.

14. The method of manufacturing a terminal assembly of claim 13 wherein providing the first insulating support member comprises:

machining the first and second arrays of apertures in the first support member, each aperture extending from a first surface of the first support member and terminating before reaching an opposite second surface of the first support member;

forming a recess in the opposite second surface of the first support member such that each aperture extends from the first surface of the first support member to a base surface of the recess.

15. The method of manufacturing a terminal assembly of claim 13, the method further comprising the steps of insertion of the sockets within the first and third arrays such that a mid portion of each respective socket extends through the interior recess; and insertion of the pins within the second and fourth arrays such that a mid portion of each respective pin extends through the interior recess.

16. The method of manufacturing a terminal assembly of claim 13, the step of providing a first insulating support member including providing the recess formed to have predetermined dimensions, the predetermined dimensions selected to produce a desired electrical characteristics within the terminal assembly.

17. A terminal assembly of the type used to provide an electrical connection between electrical devices, the terminal assembly comprising:

a first insulating support member and a second insulating support member, the first and second insulating support members joined together to form a closed body defining an interior recess;

the first insulating support member comprising a first array of apertures, each aperture extending from an upper surface of the first insulating support member to an opposite lower surface of the first insulating support member contiguous with the recess, each aperture configured to receive one of an upper portion of a socket and an upper portion of a pin, the second insulating support member comprising a second array of apertures in corresponding alignment with first array of apertures, each aperture extending from an upper surface of the second insulating support member contiguous with the recess to an opposite lower surface of the second insulating support member, each aperture configured to receive one of a lower portion of a socket and a lower portion of a pin, the terminal assembly further comprising a plurality of sockets for providing electrical connections, an upper portion of a socket received within a corresponding aperture of the first array of apertures of the first insulating support member, the upper portion of the socket terminating in an opening configured to receive a pin of a corresponding second terminal assembly, and a lower portion of the socket received with a corresponding aligned aperture in the second array of apertures of the second insulating support member, the lower portion of the socket terminating in a lower end configured to contact a corresponding electrical contact; and a plurality of pins for providing electrical connections, an upper portion of each pin received within an opening of a corresponding aperture of the first array of apertures of the first insulating support member, the upper portion of the pin terminating in an upper end configured to be received within a socket of the corresponding second terminal assembly, the lower portion of each pin terminating in a lower end configured to contact a corresponding electrical contact, wherein a mid portion of each pin and a mid portion of each socket extends through the interior recess, wherein the terminal assembly further comprises a plurality of interstitial spaces between the sockets; and a plurality of interstitial spaces between the pins; and wherein the plurality of sockets and the plurality of pins are arranged in a pattern comprising a plurality of columns, each column arranged in an alternating sequence of sockets and pins such that each interstitial space between the sockets is occupied by a pin and each interstitial space between the pins is occupied by a socket.

18. The terminal assembly of claim 17, wherein the interior recess comprises dimensions configured to provide a predetermined electrical characteristic associated with the electrical connection between electrical devices.

19. The terminal assembly of claim 17 wherein the pattern includes a plurality of rows, each row arranged in an alternating sequence of sockets and pins such that each interstitial space between the sockets is occupied by a pin and each interstitial space between the pins is occupied by a socket.

20. The terminal assembly of claim 17 wherein the first array of apertures and the second array of apertures are arranged in a pattern comprising a plurality of columns, each column having an axis, the columns located such that the distance between the axes of adjacent columns is less than a standard diameter of apertures of the first array of apertures.

21. The terminal assembly of claim 17 wherein the corresponding second terminal assembly is substantially identical to the terminal assembly.

* * * * *